US007883358B1

(12) United States Patent
Chu et al.

(10) Patent No.: US 7,883,358 B1
(45) Date of Patent: Feb. 8, 2011

(54) CONNECTION-SENSING DC PLUG AND DC CONNECTOR WITH THE SAME

(75) Inventors: Chun-Chieh Chu, Tamshui Chen (TW); Wei-Liang Lin, Tamshui Chen (TW); Chun-Ho Hua, Tamshui Chen (TW)

(73) Assignee: Acbel Polytech Inc., Tamshui Chen, Taipei Hsien (TW)

( * ) Notice: Subject to any disclaimer, the term of this patent is extended or adjusted under 35 U.S.C. 154(b) by 0 days.

(21) Appl. No.: 12/627,606

(22) Filed: Nov. 30, 2009

(51) Int. Cl.
*H01R 29/00* (2006.01)

(52) U.S. Cl. ..... 439/489; 439/638; 439/675; 439/188

(58) Field of Classification Search ..... 439/489, 439/188, 675, 638, 63
See application file for complete search history.

(56) References Cited

U.S. PATENT DOCUMENTS 5,697,501 A * 12/1997 Johansen ..... 206/719
6,837,724 B2 * 1/2005 McDaid et al. ..... 439/188
2002/0039851 A1 * 4/2002 Mou et al. ..... 439/188
2008/0248667 A1 * 10/2008 Sun ..... 439/188

* cited by examiner

*Primary Examiner*—Gary F. Paumen
(74) *Attorney, Agent, or Firm*—C. G. Mersereau; Nikolai & Mersereau, P.A.

(57) ABSTRACT

A connection-sensing DC plug has an insulative body, a connection portion, two power terminals, a conductive sheet and a retractable pin. The connecting portion is adapted to electronically connect to a target device and has an isolation layer and a ground layer. The conductive sheet is mounted in the insulative body and contacts either the isolation layer or the ground layer. The retractable pin is movably mounted in the insulative housing parallel to the connecting portion, with one end securely engaging the conductive sheet and the other end protruding from the insulative body. When the DC plug is connected to the target device, the retractable pin is pressed and moves inward to bend the conductive sheet, turning the conductive sheet to a floating state and resulting in a trigger signal.

20 Claims, 5 Drawing Sheets

CONNECTION-SENSING DC PLUG AND DC CONNECTOR WITH THE SAME

BACKGROUND OF THE INVENTION

1. Field of the Invention

The present invention relates to a connection-sensing DC plug, and more particularly to a DC plug that provides a trigger signal when the DC plug is connected to a target device.

2. Description of Related Art

Most portable electronic devices such as cell phones or notebook computers use standard DC plugs to receive power. Generally, the DC plug is connected to an AC to DC adapter via a wire and has a connecting portion to be inserted into a matching socket mounted in a target device to be powered.

Since the DC plug are manufactured in accordance with common standards, the main aim for most fabricators is to improve conductivity or electrical characteristics of the DC plug rather than giving additional functions.

To overcome the shortcomings, the present invention provides a connection sensing DC connector to mitigate or obviate the aforementioned problems.

SUMMARY OF THE INVENTION

An objective of the present invention is to provide a connection-sensing DC plug that is able to provide a trigger signal indicating that the DC plug has been connected to a target device.

To achieve the objective, the connection-sensing DC plug has an insulative body, a connection portion, two power terminals, a conductive sheet and a retractable pin.

The insulative body has a bottom opening and a chamber communicating with the bottom opening.

The connecting portion is partially mounted in the insulative body and has a power layer, an isolation layer and a ground layer.

The conductive sheet is mounted in the insulative body and contacts either the isolation layer or the ground layer.

The retractable pin is movably mounted in the insulative housing parallel to the connecting portion, with one end securely engaging the conductive sheet and the other end protruding from the insulative body.

When the DC plug is connected to the target device, the retractable pin abuts against the target device and moves inward to bend the conductive sheet, turning the conductive sheet to a floating state and resulting in a state change signal.

Another objective of the present invention is to provide a connection-sensing connector. The connection-sensing connector has a DC plug and an output jack that matches the DC plug and is electronically connected to the power terminals and the wire terminal of the DC plug.

Other objectives, advantages and novel features of the invention will become more apparent from the following detailed description when taken in conjunction with the accompanying drawings.

DETAILED DESCRIPTION OF PREFERRED EMBODIMENT

Figure 1:
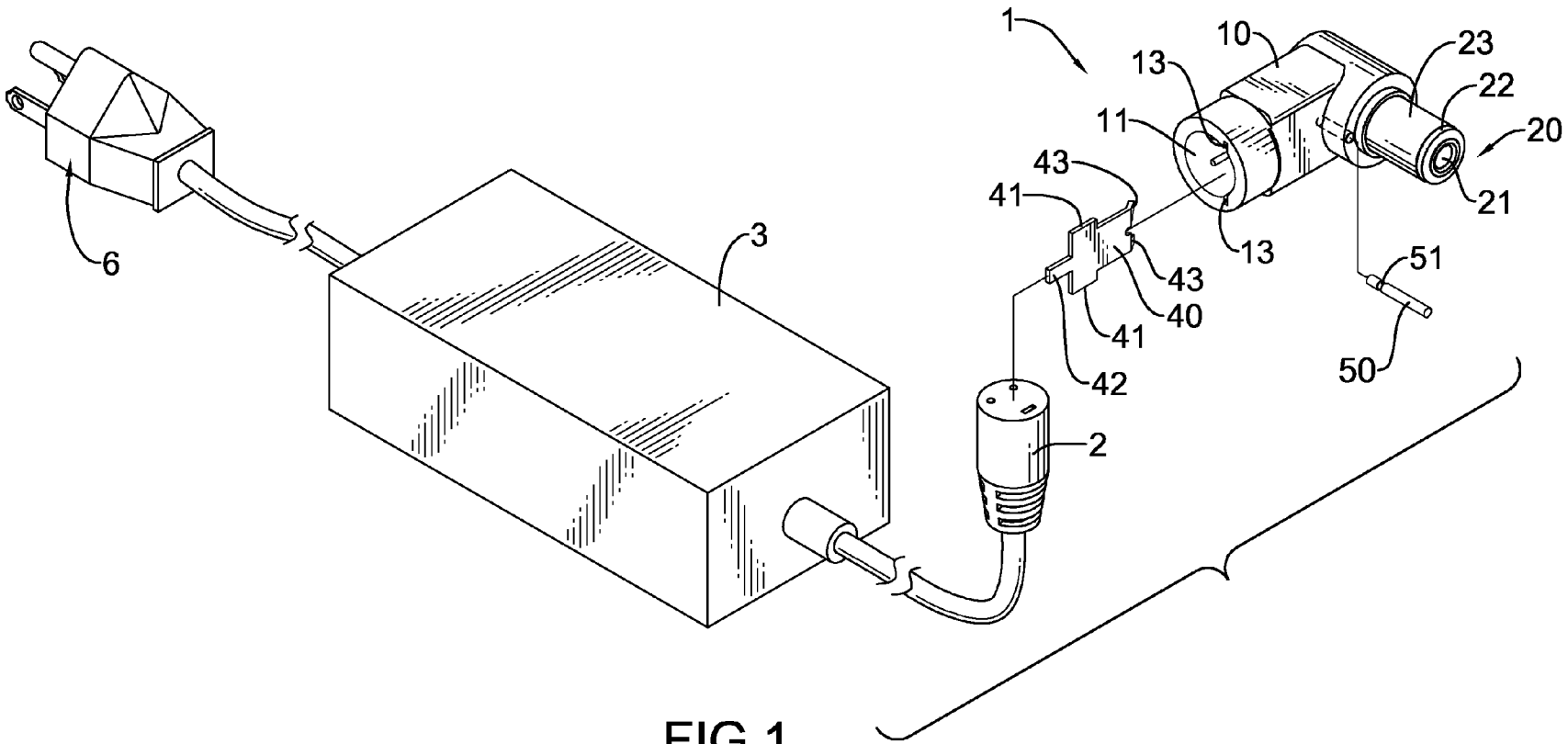
FIG. 1 is a partially exploded perspective view of a DC plug in accordance with the present invention.
Figure 2:
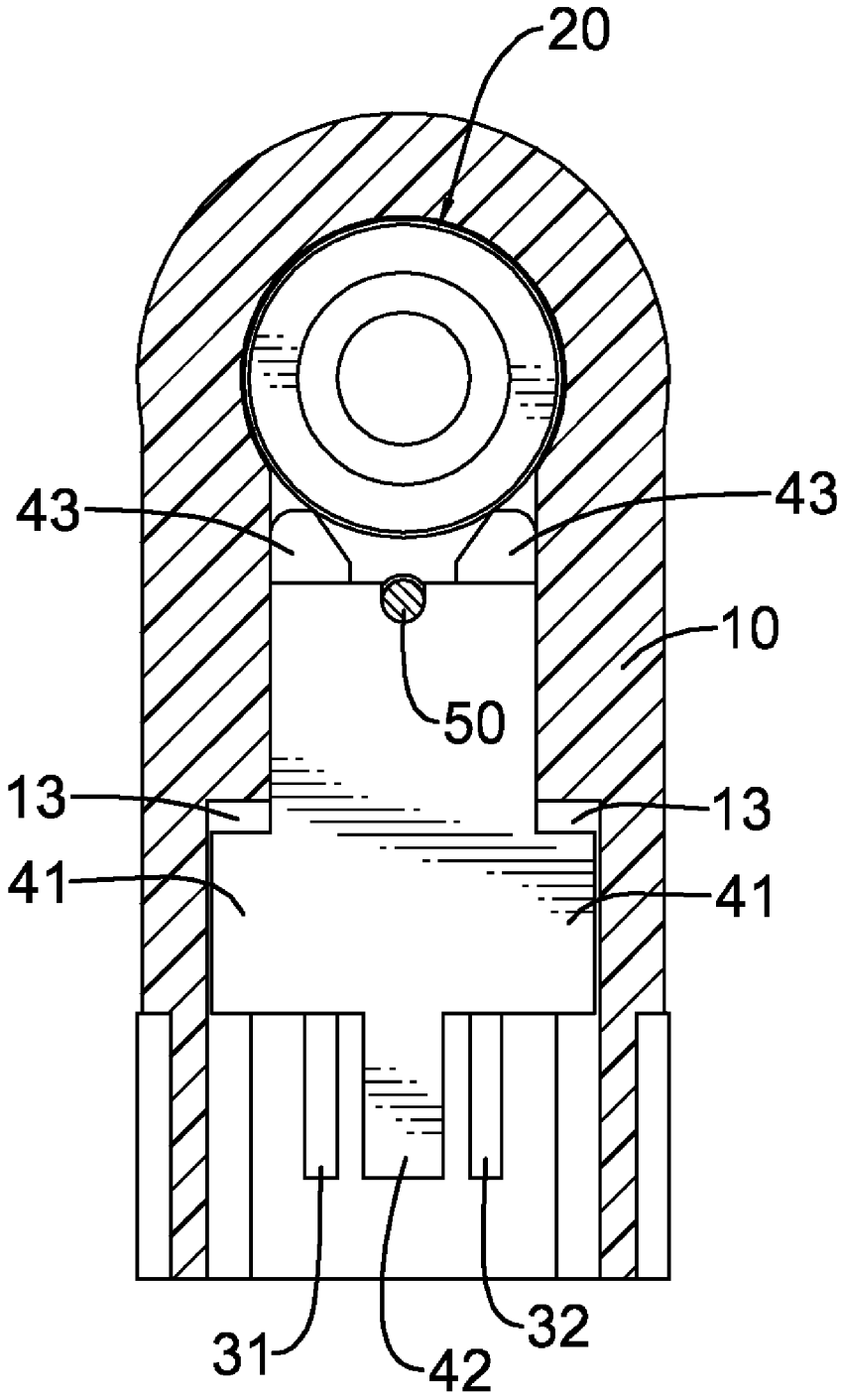
FIG. 2 is a front cross-sectional view of the DC plug in accordance with the present invention.
Figure 3:
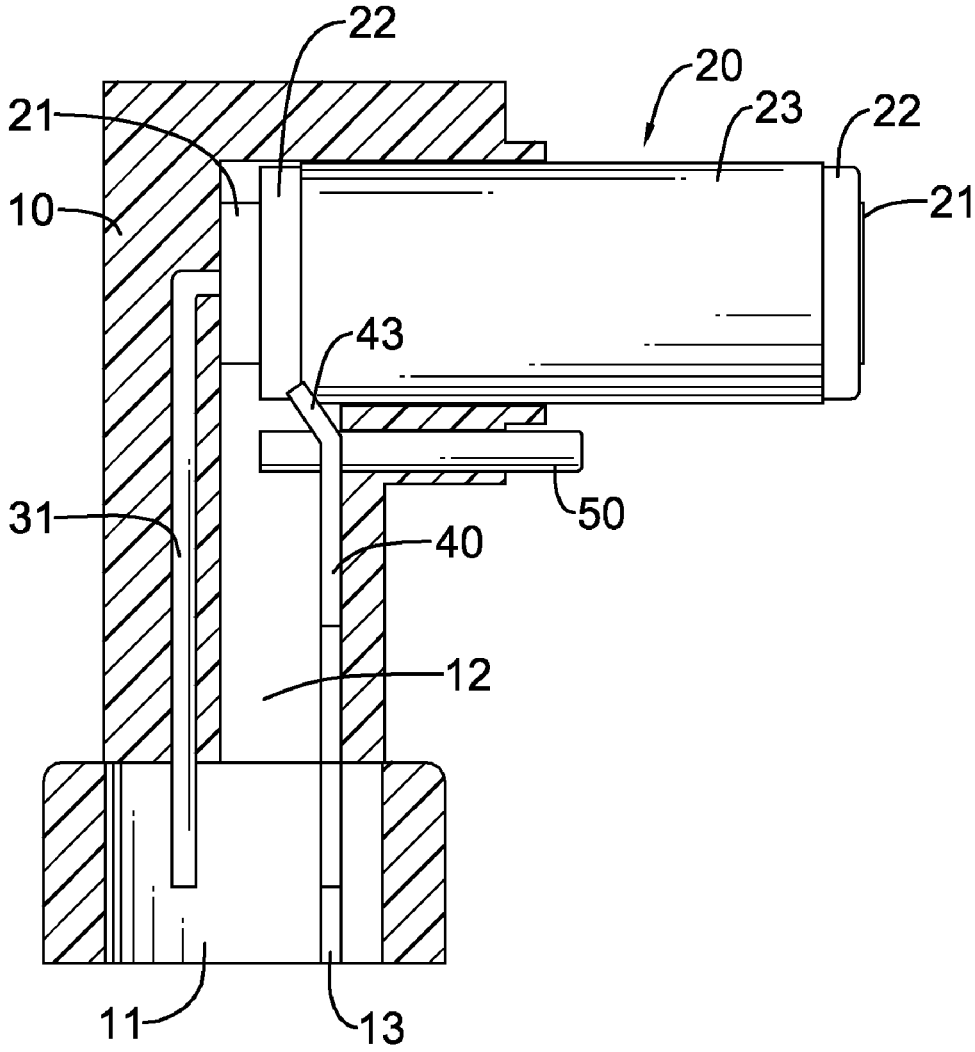
FIG. 3 is a lateral cross-sectional view of the DC plug in accordance with the present invention.

With reference to FIGS. 1 to 3, a DC plug (1) in accordance with the present invention comprises an insulative body (10), a connecting portion (20), two power terminals (31) (32), a conductive sheet (40) and a retractable pin (50).

The insulative body (10) can be L-shaped or cylindrical and has a bottom opening (11), a chamber (12) and may further have two grooves (13). The chamber (12) is formed inside the insulative body (10), communicates with the bottom opening (11) and has an inner wall. The two grooves (13) are defined oppositely in the inner wall of the chamber (12).

The connecting portion (20) is hollow and cylindrical and has a first end and a second end. The first end is mounted in the insulative body (10) and the second end protrudes from the insulative body (10) for inserting into a matching socket of a target device. The connection portion (20) comprises an internal power layer (21), an intermediate isolation layer (22) and an outer ground layer (23).

The two power terminals (31) (32) are mounted in the insulative body (10), held in the chamber (12) of the insulative body (10), and respectively contact the internal power layer (21) and the outer ground layer (23).

The conductive sheet (40) is mounted in the chamber (12) and selectively contacts either the outer ground layer (23) or the intermediate isolation layer (22). In a preferable embodiment, the conductive sheet (40) comprises a rectangular body with two long edges and two short edges, two flanges (41), a signal terminal (42) and two conductive protrusions (43). The two flanges (41) extend oppositely from the two long edges of the rectangular body and mounted in the two grooves (13). The signal terminal (42) protrudes from one short edge of the rectangular body toward the bottom opening (11). The two conductive protrusions (43) are formed on the other short edge of the rectangular body, separated from each other and substantially inclined to the rectangular body. The two conductive protrusions (43) contact the outer ground layer (23) in a normal state. When the conductive sheet (40) is pushed inwards by external force, the two conductive protrusions (43) are in a floating state, defined as in contact the intermediate isolation layer (22).

The retractable pin (50) is movably and partially mounted in the insulative body (10) parallel to the connecting portion (20). The retractable pin (50) has a first end, a second end, an outer surface and an annular cut (51) formed in the outer surface near the first end. The first end extends into the chamber (12) of the insulative housing (10) so that the short edge of the conductive plate (40) securely engages the annular cut (51). The second end protrudes from the insulative body (10) as a free end. As shown in FIG. 3, when the retractable pin (50) is in the normal state and not pushed or pressed, the conductive protrusions (43) of the conductive sheet (40) remain in contact with the outer ground layer (23). Otherwise, when the retractable pin (50) is pushed inward, the conductive plate (40) moves inward at the same time and makes the two conductive protrusions (43) to be in the floating state and touch the intermediate isolation layer (22).

With reference to FIG. 1, the DC plug (1) can be assembled to a matching output jack (2) to form a DC connector. For example, the DC connector may be connected to a cable of an AC to DC adapter (3) for a notebook computer, wherein the AC to DC adapter (3) receives AC voltage via an AC plug (6) and outputs DC voltage from the DC connector. The cable consists of DC power wires and a signal wire.

The output jack (2) is mounted in the bottom opening (11) and has multiple contacting holes. When the output jack (2) and the DC plug (1) are assembled, the two power terminals (31) (32) and the signal terminal (42) correspondingly insert into the contacting holes of the output jack (2). Therefore, the two power terminals (31) (32) and the signal terminal (42) are electrically connected to the DC power wires and the signal wire of the cable.

Figure 4:
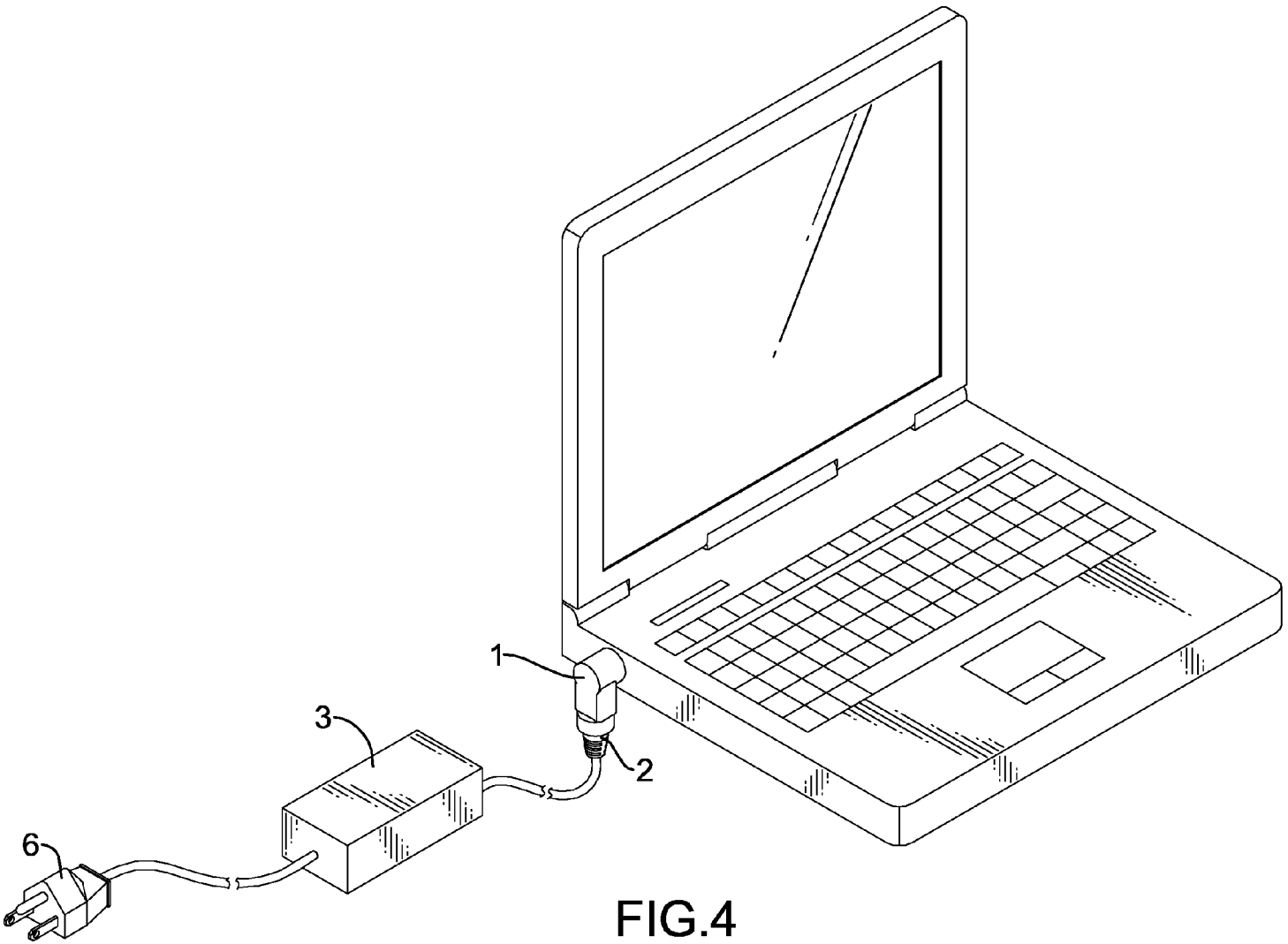
FIG. 4 is an operational view of the DC plug in accordance with the present invention connected to a target device.
Figure 5:
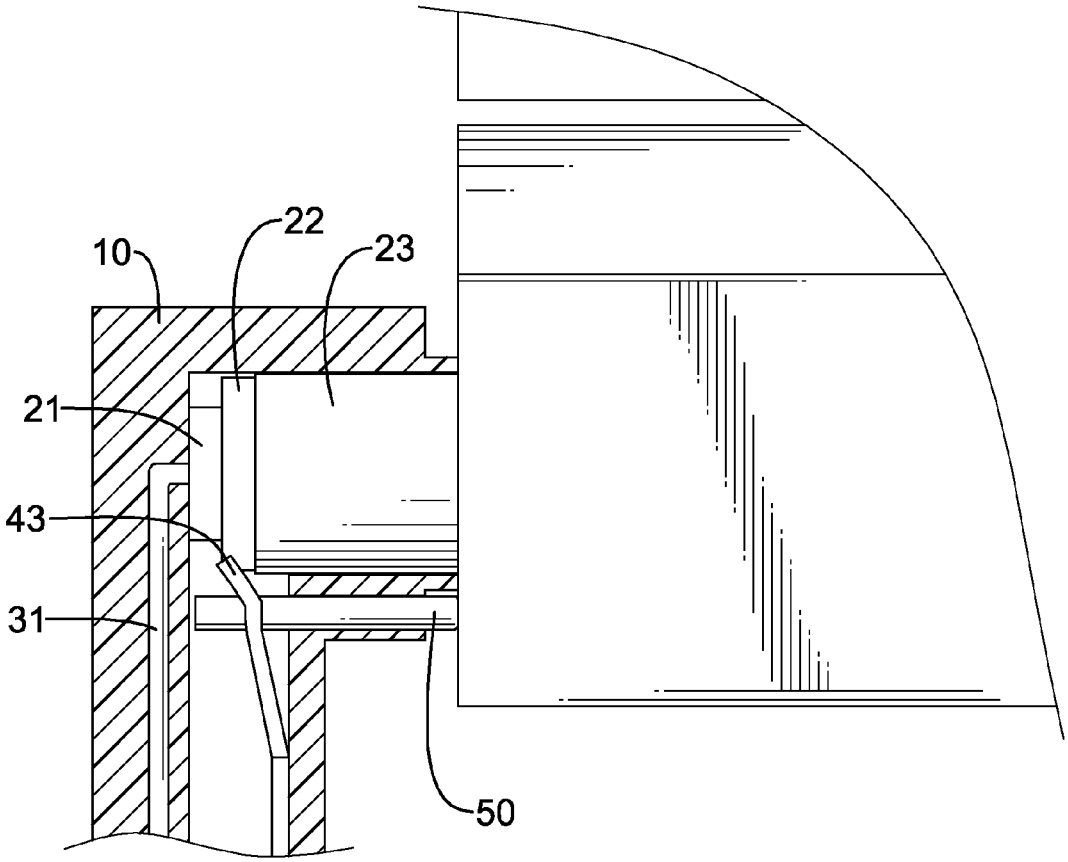
FIG. 5 is an enlarged cross-sectional view of the DC plug in accordance with the present invention connected to a target device.

With further reference to FIGS. 4 and 5, when the notebook computer has to be charged, the connection portion (20) of the DC plug (1) inserts into a DC charging port of the notebook computer. The retractable pin (50) abuts against the case of the notebook computer and moves inward to bend the conductive sheet (40), causing the two conductive protrusions (43) to touch the intermediate isolation layer (22). The conductive sheet (40), originally in the normal state and contacting the outer ground layer (23), turns to the floating state. The change of the state is transmitted to and sensing by a control circuit mounted in the AC to DC adapter (3). Therefore, the control circuit easily recognizes whether the DC plug (1) has been connected to the notebook computer based on the change of state. The change of the state can be used as a trigger signal for many applications such as a power saving function. For instance, when the DC plug (1) is not connected to the notebook computer, the AC to DC adapter (3) can automatically activate the power saving function to reduce power consumption.

In addition to transmitting power, the DC plug (1) in accordance with the present invention further provides a trigger signal when the DC plug (1) itself has been connected to a target device. The trigger signal can be applied in different applications depended on practical requirements.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A connection-sensing DC plug comprising:

an insulative body having a bottom opening and a chamber communicating with the bottom opening;

a hollow connecting portion and cylindrical and comprising an internal power layer, an intermediate isolation layer and an outer ground layer, and having a first end mounted in the insulative body; and a second end protruding from the insulative body;

two power terminals mounted in the insulative body, held in the chamber and respectively contacting the internal power layer and the outer ground layer of the connecting portion;

a conductive sheet mounted in the chamber and selectively contacting the outer ground layer in a normal state and turning into a floating state when the conductive sheet is pushed;

a retractable pin movably and partially mounted in the insulative body parallel to the connecting portion and having a first end extending into the chamber of the insulative body and engaging the conductive sheet; and a second end protruding from the insulative body.

2. The DC plug as claimed in claim 1, wherein the chamber of the insulative body has an inner wall and two grooves are defined oppositely in the inner wall to hold the conductive sheet.

3. The DC plug as claimed in claim 2, wherein the conductive sheet comprises two opposite edges; and two flanges formed on and protruding from the two opposite edges of the conductive sheet and mounted in the two grooves respectively.

4. The DC plug as claimed in claim 3, the conductive sheet comprising a rectangular body having two opposite long edges and two opposite short edges, wherein the two flanges are formed on the two opposite edges respectively;

two conductive protrusions formed on one of the short edges of the rectangular body, separated from each other, inclined to the rectangular body, and contacting either the outer ground layer or the intermediate isolation layer of the connecting portion; and a signal pin formed on and protruding from the other short edge of the rectangular body.

5. The DC plug as claimed in claim 1, wherein the retractable pin has an annular cut engaging the conductive sheet.

6. The DC plug as claimed in claim 2, wherein the retractable pin has an annular cut engaging the conductive sheet.

7. The DC plug as claimed in claim 3, wherein the retractable pin has an annular cut engaging the conductive sheet.

8. The DC plug as claimed in claim 4, wherein the retractable pin has an annular cut engaging the conductive sheet.

9. The DC plug as claimed in claim 7, wherein the conductive sheet turns into the floating state when the conductive sheet contacts the intermediate isolation layer.

10. The DC plug as claimed in claim 8, wherein the conductive sheet turns into the floating state when the conductive sheet contacts the intermediate isolation layer.

11. A connection-sensing DC connector comprising a DC plug and an output jack;

the DC plug comprising:

an insulative body having a bottom opening and a chamber communicating with the bottom opening;

a hollow connecting portion and cylindrical and comprising an internal power layer, an intermediate isolation layer and an outer ground layer, and having a first end mounted in the insulative body; and a second end protruding from the insulative body;

two power terminals mounted in the insulative body, held in the chamber and respectively contacting the internal power layer and the outer ground layer of the connecting portion;

a conductive sheet mounted in the chamber and selectively contacting the outer ground layer in a normal state and becoming a floating state when the conductive sheet experiencing a pushing force;

a retractable pin movably and partially mounted in the insulative body parallel to the connecting portion and having a first end extending into the chamber of the insulative body and engaging the conductive sheet; and a second end protruding from the insulative body;

the output jack accommodating the DC plug and electrically connected to the two power terminals and the signal terminal.

12. The DC connector as claimed in claim 11, wherein the chamber of the insulative body has an inner wall and two grooves are defined oppositely in the inner wall to hold the conductive sheet.

13. The DC connector as claimed in claim 12, wherein the conductive sheet comprises two opposite edges; and two flanges formed on and protruding from the two opposite edges of the conductive sheet and mounted in the two grooves respectively.

14. The DC connector as claimed in claim 13, the conductive sheet comprising a rectangular body having two opposite long edges and two opposite short edges, wherein the two flanges are formed on the two opposite edges respectively;

two conductive protrusions formed on one of the short edges of the rectangular body, separated from each other, inclined to the rectangular body, and contacting either the outer ground layer or the intermediate isolation layer of the connecting portion; and a signal pin formed on and protruding from the other short edge of the rectangular body.

15. The DC connector as claimed in claim 11, wherein the retractable pin has an annular cut engaging the conductive sheet.

16. The DC connector as claimed in claim 12, wherein the retractable pin has an annular cut engaging the conductive sheet.

17. The DC connector as claimed in claim 13, wherein the retractable pin has an annular cut engaging the conductive sheet.

18. The DC connector as claimed in claim 14, wherein the retractable pin has an annular cut engaging the conductive sheet.

19. The DC connector as claimed in claim 18, wherein the output jack is mounted in the bottom opening of the insulative body and has multiple contacting holes for electrically connecting the two power terminals and the signal terminal.

20. The DC connector as claimed in claim 18 wherein the conductive sheet turns into the floating state when the conductive sheet contacts the intermediate isolation layer.

* * * * *